US006368191B1

(12) United States Patent
Zuniga et al.

(10) Patent No.: US 6,368,191 B1
(45) Date of Patent: Apr. 9, 2002

(54) CARRIER HEAD WITH LOCAL PRESSURE CONTROL FOR A CHEMICAL MECHANICAL POLISHING APPARATUS

(75) Inventors: Steven M. Zuniga, Soquel; Hung Chih Chen, San Jose; Manoocher Birang, Los Gatos; Kapila Wijekoon, Santa Clara; Sen-Hou Ko, Cupertino, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/665,838

(22) Filed: Sep. 20, 2000

Related U.S. Application Data

(62) Division of application No. 08/907,810, filed on Aug. 8, 1997, now Pat. No. 6,146,259, which is a continuation-in-part of application No. 08/861,260, filed on May 21, 1997, which is a continuation of application No. 08/745,679, filed on Nov. 8, 1996, now abandoned.

(51) Int. Cl.[7] ..... B24B 1/00

(52) U.S. Cl. ..... 451/41; 451/287; 451/288; 451/397; 451/398

(58) Field of Search ..... 451/41, 63, 285, 451/287, 288, 289, 397, 398

(56) References Cited

U.S. PATENT DOCUMENTS

| | | | | |
|---|---|---|---|---|
| 4,373,991 A | | 2/1983 | Banks | |
| 4,918,869 A | * | 4/1990 | Kitta | 451/288 |
| 5,081,795 A | | 1/1992 | Tanaka et al. | |
| 5,193,316 A | | 3/1993 | Olmstead | |
| 5,205,082 A | | 4/1993 | Shendon et al. | |
| 5,230,184 A | | 7/1993 | Bukhman | |
| 5,423,558 A | | 6/1995 | Koeth et al. | |
| 5,423,716 A | | 6/1995 | Strasbaugh | |
| 5,441,444 A | | 8/1995 | Nakajima | |
| 5,443,416 A | | 8/1995 | Volodarsky et al. | |
| 5,476,414 A | | 12/1995 | Hirose et al. | |
| 5,498,199 A | | 3/1996 | Karlsrud et al. | |
| 5,584,746 A | * | 12/1996 | Tanaka et al. | 451/288 |
| 5,584,751 A | | 12/1996 | Kobayashi et al. | |
| 5,605,488 A | * | 2/1997 | Ohashi et al. | 451/288 |
| 5,624,299 A | | 4/1997 | Shendon | |
| 5,635,083 A | | 6/1997 | Breivogel et al. | |
| 5,643,053 A | | 7/1997 | Shendon | |
| 5,681,215 A | | 10/1997 | Sherwood et al. | |
| 5,733,182 A | | 3/1998 | Muramatsu et al. | |
| 5,795,215 A | | 8/1998 | Guthrie et al. | |
| 5,803,799 A | | 9/1998 | Volodarsky et al. | |
| 5,820,448 A | | 10/1998 | Shamouilian et al. | |
| 5,851,140 A | * | 12/1998 | Barns et al. | 451/288 |
| 6,146,259 A | | 11/2000 | Zuniga et al. | |

FOREIGN PATENT DOCUMENTS

| | | |
|---|---|---|
| DE | 8631087.5 | 4/1987 |
| EP | 0 156 746 A1 | 10/1985 |
| EP | 0 653 270 A1 | 5/1995 |
| JP | 61-25768 | 2/1986 |
| JP | 63-114870 | 5/1988 |
| JP | 63-300858 | 12/1988 |
| JP | 1-216768 | 8/1989 |
| JP | 2-224263 | 9/1990 |
| JP | 05277929 | 10/1993 |

* cited by examiner

*Primary Examiner*—Derris H. Banks
(74) *Attorney, Agent, or Firm*—Fish & Richardson

(57) ABSTRACT

A carrier head for a chemical mechanical polishing apparatus includes a flexible membrane, the lower surface of which provides a substrate-receiving surface. The carrier head may include a projection which contacts an upper surface of the flexible membrane to apply an increased load to a potentially underpolished region of a substrate. Fluid jets may be used for the same purpose.

17 Claims, 10 Drawing Sheets

PRESSURE REGULATOR
93b
98b
92b
96b
90
92a
98a
93a
PRESSURE REGULATOR
96a
93c
98c
92c
PRESSURE REGULATOR
96c
99
COMPUTER
76
70a
74
87
80
78
72
66
94a
94c
94b
100

CARRIER HEAD WITH LOCAL PRESSURE CONTROL FOR A CHEMICAL MECHANICAL POLISHING APPARATUS

CROSS-REFERENCE TO RELATED APPLICATIONS

This application is a divisional of U.S. application Ser. No. 08/907,810, filed Aug. 8, 1997 now U.S. Pat. No. 6,146,259, which is a continuation-in-part of U.S. application Ser. No. 08/861,260, filed May 21, 1997, which is a continuation of U.S. application Ser. No. 08/745,679, filed Nov. 8, 1996 now abandoned.

BACKGROUND OF THE INVENTION

The present invention relates generally to chemical mechanical polishing of substrates, and more particularly to a carrier head for a chemical mechanical polishing apparatus.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect", i.e., the tendency for the edge of the substrate to be polished at a different rate than the center of the substrate. The edge effect typically results in over-polishing (the removal of too much material from the substrate) of the substrate perimeter, e.g., the outermost five to ten millimeters of a 200 mm wafer. This over-polishing reduces the overall flatness of the substrate, makes the edge of the substrate unsuitable for integrated circuit fabrication, and decreases the process yield.

In view of the foregoing, there is a need for a CMP which provides the desired substrate surface flatness and finish while reducing or minimizing the edge effect.

SUMMARY OF THE INVENTION

In one aspect, the invention is directed to a carrier head for a chemical mechanical polishing apparatus the carrier head includes a base, a support structure movably connected to the base, and a flexible member connected to and extending beneath the support structure. A lower surface of the flexible member provides a substrate-receiving surface. A projection extends from the support structure to contact an upper surface of the flexible member at a location interior to an outer perimeter of the substrate-receiving surface.

Implementations of the invention may include the following. The carrier head may have a pressure mechanism, such as a bladder, for applying a downward force to the support structure. A retaining ring may be connected to the base and define a substrate-receiving recess. The contact area may be substantially contiguous with a region of a substrate which is potentially underpolished. The projection may contact the upper surface of the flexible member in a substantially annular contact area, or in a substantially circular contact area near the center of the substrate-receiving surface. The projection may be detachable from the support member. The lower surface of the support member may include one or more annular recesses, and the projection may comprise one or more O-rings fitted into the recesses. An outer edge of the support member may include a downwardly-projecting rim, the flexible member may extend around the outer edge of the support member, and the projection may be located interior to the rim.

In another aspect, the invention is directed to a carrier head for a chemical mechanical polishing apparatus having a port in fluid communication with a chamber through which fluid is directed to generate a stream of fluid. The carrier head has a base and a flexible member connected to and extending beneath the base to define the chamber. A lower surface of the flexible member provides a substrate-receiving surface. The stream impinges upon an upper surface of the flexible member to create a localized area of increased pressure.

Implementations of the invention may include the following. The localized area of increased pressure may be substantially contiguous with a region of the substrate which is potentially underpolished, and may be located interior to an outer edge of the substrate-receiving surface. The fluid may be air. The carrier head may have a support structure having a passage extending therethrough, where one end of the passage is fluidly coupled to a pump and another end of the passage is fluidly coupled to the port.

In another aspect, the invention is directed to a carrier head having a base, a support structure, and a flexible member to define a chamber. A lower surface of the flexible member provides a substrate-receiving surface. The chamber is pressurizable to providing a first force to an upper surface of the flexible member. The carrier head also has means for applying a second, additional force to the upper surface of the flexible member in a localized contact area located interior to an outer edge of the substrate-receiving surface.

In another aspect, the invention is directed to a method of polishing a substrate. The method includes placing a first face of the substrate against a substrate-receiving surface of a flexible member of a carrier head, the flexible member connected to and extending beneath a support structure of the carrier head to define a chamber, and positioning a second face of the substrate against a polishing pad. The chamber is pressurized to apply a first force to an upper surface of the flexible member, and a second, additional force is applied to the upper surface of the flexible member in a localized contact area.

Implementations of the invention may include the following. The localized contact area may be located interior to an outer edge of the substrate-receiving surface, and may be substantially contiguous with a region of the substrate which is potentially underpolished. The additional force may be applied by contacting the upper surface of the flexible member with a projection which extends from the support structure, or by contacting the upper surface of the flexible member with a fluid stream.

In another aspect, the invention is directed to a carrier head for a chemical mechanical polishing apparatus. The carrier head includes a base, a support structure movably connected to the base, and a flexible member connected to and extending beneath the support structure. A lower surface of the flexible member provides a substrate-receiving surface. An annular seal is connected to the base and abuts an upper surface of the flexible member to define an inner chamber and an outer chamber around the inner chamber. The inner and outer chambers are pressurizable to force the annular seal against the flexible member to create a substantially fluid-tight seal between the inner chamber and the outer chamber.

Implementations of the invention may include the following. The carrier head may include a first pump fluidly coupled to the inner chamber and a second pump fluidly coupled to the outer chamber so that pressures in the chambers may be independently controlled. The annular seal may include a base portion contacting the flexible member and a stem portion clamped to the base. Advantages of the invention include the following. The edge effect is reduced, and the resulting flatness and finish of the substrate is substantially uniform.

Other advantages and features of the invention will be apparent from the following description, including the drawings and claims.

BRIEF DESCRIPTION OF THE DRAWINGS

Like reference numbers are designated in the various drawings to indicate like elements. A primed reference number indicates that an element has a modified function, operation or structure.

DESCRIPTION OF THE PREFERRED EMBODIMENT(S)

Figure 1:
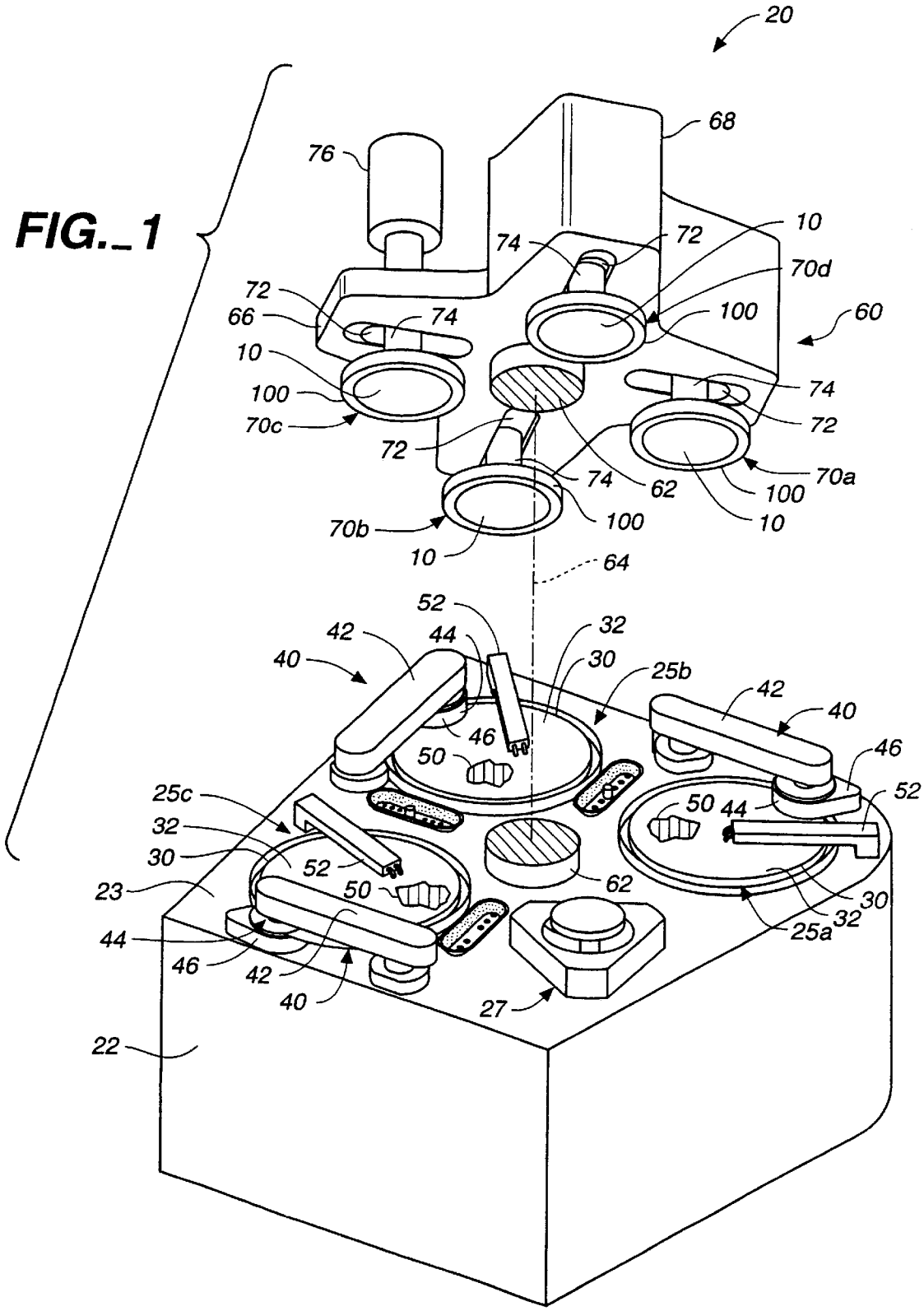
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus 20 may be found in pending U.S. application Ser. No. 08/549,336, by Perlov, et al., filed Oct. 27, 1995, entitled CONTINUOUS PROCESSING SYSTEM FOR CHEMICAL MECHANICAL POLISHING, and assigned to the assignee of the present invention, the entire disclosure of which is hereby incorporated by reference.

The CMP apparatus 20 includes a lower machine base 22 with a table top 23 mounted thereon and a removable upper outer cover (not shown). Table top 23 supports a series of polishing stations 25*a*, 25*b* and 25*c*, and a transfer station 27. Transfer station 27 may form a generally square arrangement with the three polishing stations 25*a*, 25*b* and 25*c*. Transfer station 27 serves multiple functions of receiving individual substrates 10 from a loading apparatus (not shown), washing the substrates, loading the substrates into carrier heads (to be described below), receiving the substrates from the carrier heads, washing the substrates again, and finally transferring the substrates back to the loading apparatus.

Each polishing station 25*a*–25*c* includes a rotatable platen 30 on which is placed a polishing pad 32. If substrate 10 is an eight-inch (200 millimeter) diameter disk, then platen 30 and polishing pad 32 will be about twenty inches in diameter. Platen 30 may be connected by a platen drive shaft (not shown) to a platen drive motor (also not shown).

Each polishing station 25*a*–25*c* may further include an associated pad conditioner apparatus 40. Each pad conditioner apparatus 40 has a rotatable arm 42 holding an independently rotating conditioner head 44 and an associated washing basin 46. The conditioner apparatus maintains the condition of the polishing pad so that it will effectively polish any substrate pressed against it while it is rotating.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against polishing pads of polishing stations 25*a*–25*c*. One of the carrier head systems receives a substrate from and delivers the substrate to transfer station 27. The carousel motor may orbit carrier head systems 70*a*–70*d*, and the substrates attached thereto, about carousel axis 64 between the polishing stations and the transfer station.

Each carrier head system 70*a*–70*d* includes a polishing or carrier head 100. Each carrier head 100 independently rotates about its own axis, and independently laterally oscillates in a radial slot 72 formed in carousel support plate 66. A carrier drive shaft 74 extends through a drive shaft housing 78 (see FIG. 3) to connect a carrier head rotation motor 76 to carrier head 100 (shown by the removal of one-quarter of cover 68). There is one carrier drive shaft and motor for each head.

Figure 2:
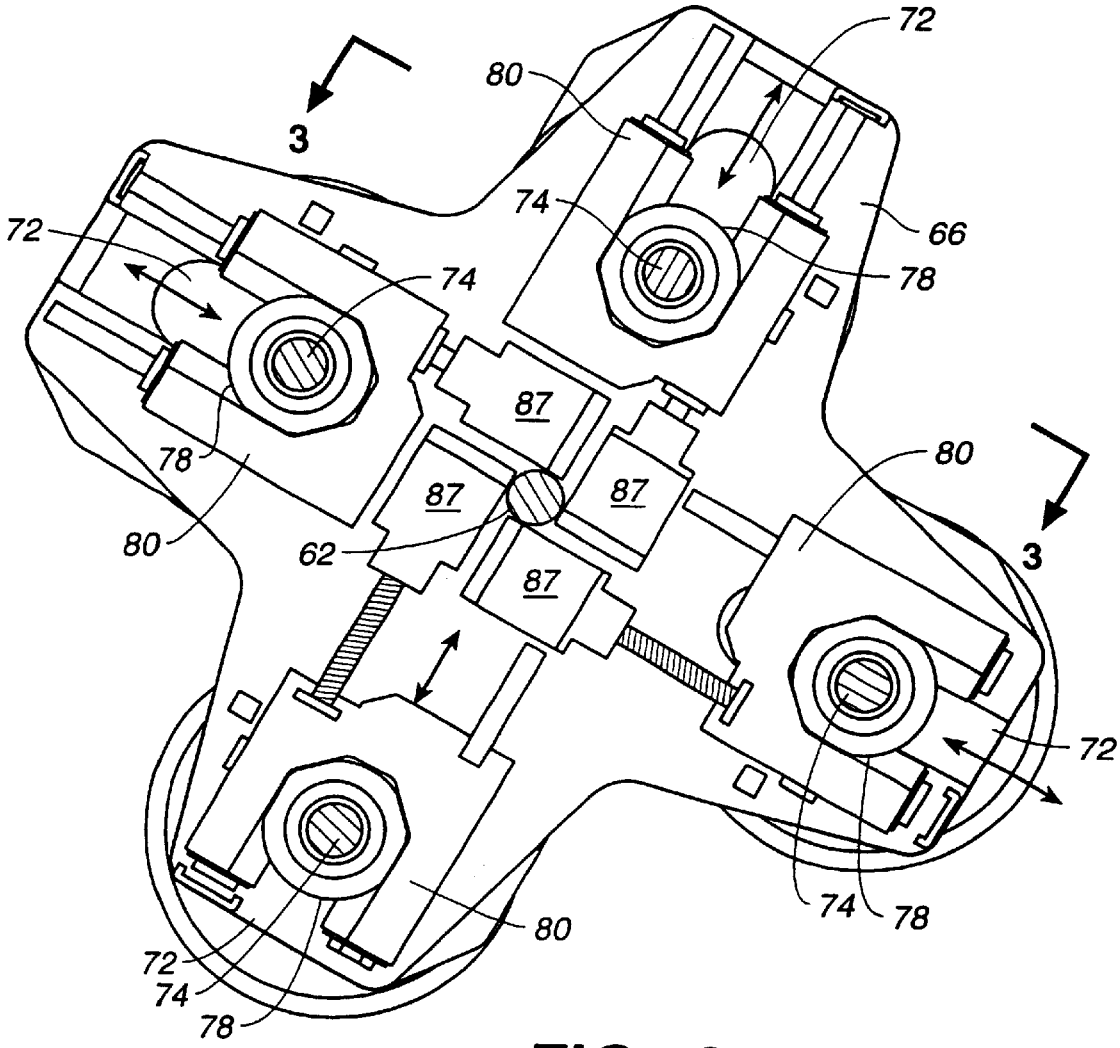
FIG. 2 is a schematic top view of a carousel, with the upper housing removed.

Referring to FIG. 2, in which cover 68 of carousel 60 has been removed. The top of carousel support plate 66 supports four slotted carrier head support slides 80. Each slide 80 is aligned with one of radial slots 72 and may be driven along the slot by a radial oscillator motor 87. The four motors 87 are independently operable to independently move the four slides along radial slots 72 in carousel support plate 66.

Figure 3:
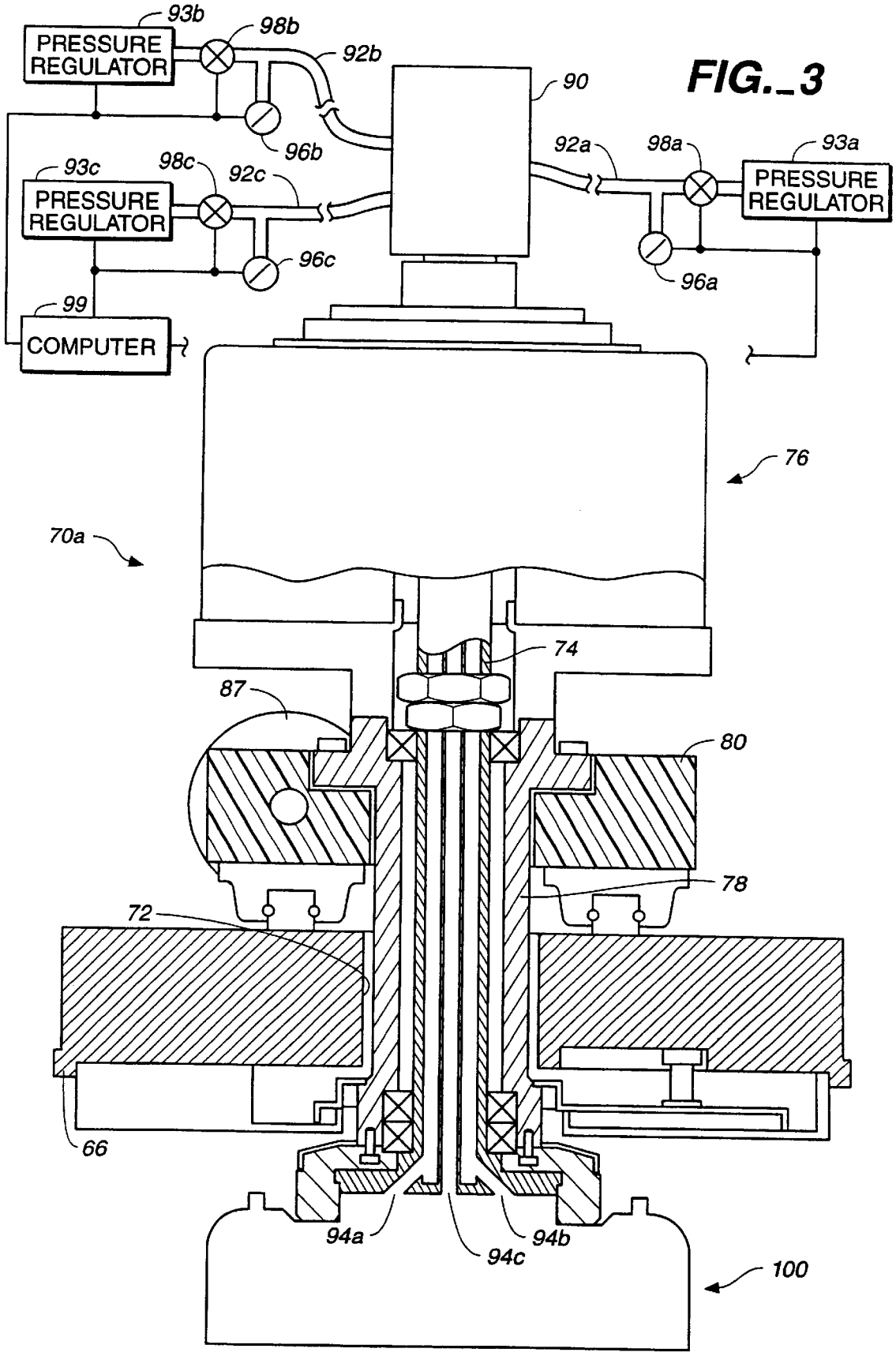
FIG. 3 is partially a cross-sectional view of the carousel of FIG. 2 along line 3—3, and partially a schematic diagram of the pressure regulators used by the CMP apparatus.

Referring to FIG. 3, a rotary coupling 90 at the top of drive motor 76 couples three or more fluid lines 92*a*, 92*b* and 92*c* to three or more channels 94*a*, 94*b* and 94*c*, respectively, in drive shaft 74. Three vacuum or pressure sources 93*a*, 93*b* and 93*c*, such as pumps, venturis or pressure regulators (hereinafter referred to simply as "pumps"), may be connected to fluid lines 92*a*, 92*b* and 92*c*, respectively. Three pressure sensors or gauges 96*a*, 96*b* and 96*c* may be connected to fluid lines 92*a*, 92*b* and 92*c*, respectively. Controllable valves 98*a*, 98*b* and 98*c* may be connected across the fluid lines 92*a*, 92*b* and 92*c*, respectively. Pumps 93*a*–93*c*, pressure gauges 96*a*–96*c* and valves 98*a*–98*c* may be appropriately connected to a general-purpose digital computer 99. Computer 99 may operate pumps 93*a*–93*c*, as described in more detail below, to pneumatically power carrier head 100.

During actual polishing, three of the carrier heads, e.g., those of carrier head systems 70*a*–70*c*, are positioned at and above respective polishing stations 25*a*–25*c*. Each carrier head 100 lowers a substrate into contact with polishing pad 32. As noted, slurry 50 acts as the media for chemical mechanical polishing of the substrate.

Generally, carrier head 100 holds the substrate in position against the polishing pad and distributes a force across the back surface of the substrate. The carrier head also transfers torque from the drive shaft to the substrate.

Figure 4:
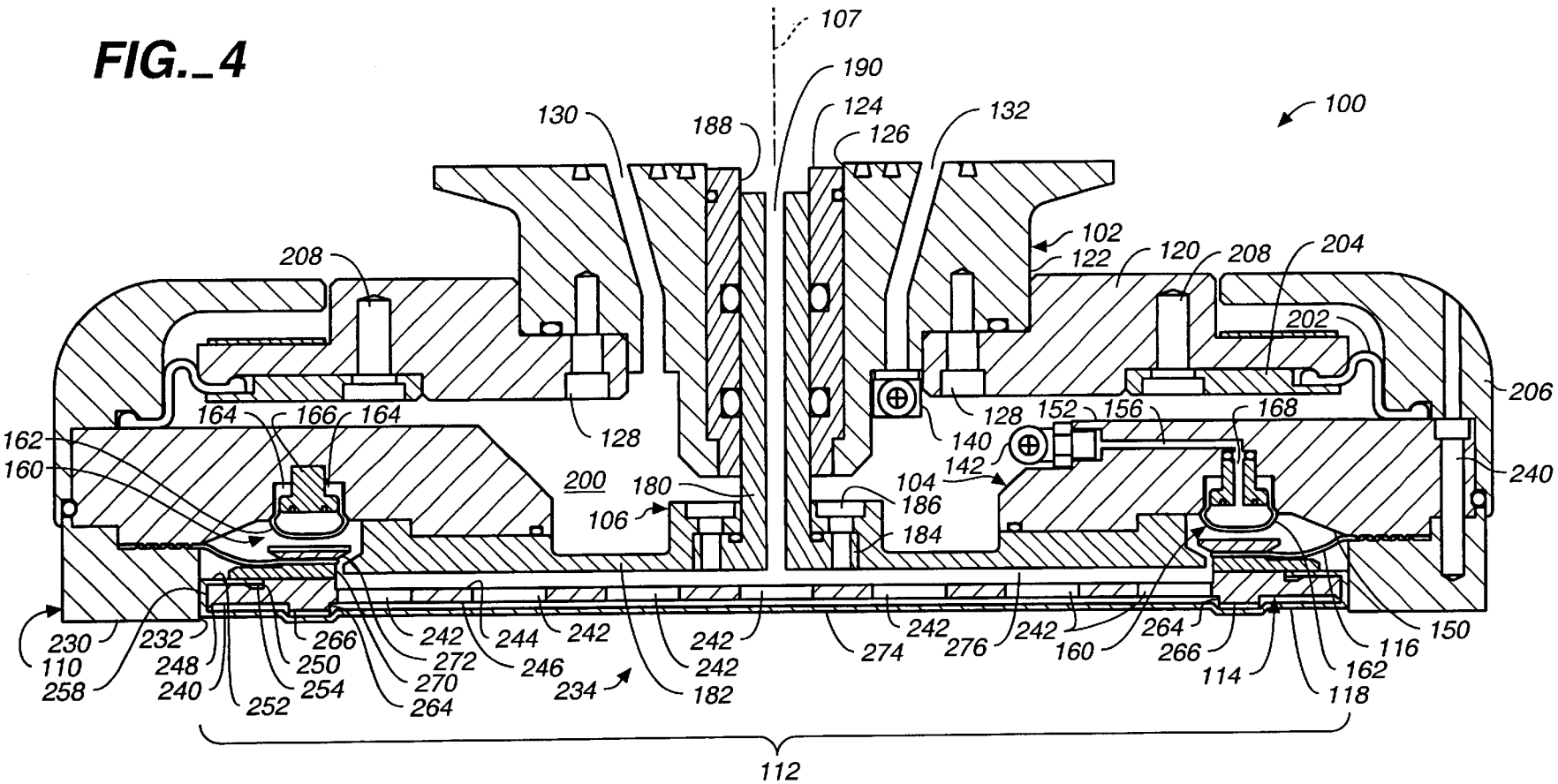
FIG. 4 is a schematic cross-sectional view of a carrier head according to the present invention.

Referring to FIG. 4, carrier head 100 includes a housing 102, a base 104, a gimbal mechanism 106, a loading chamber 200, a retaining ring 110, and a substrate backing assembly 112. A description of a similar carrier head may be found in the above-identified U.S. application Ser. No. 08/745,670, which has been incorporated by reference.

The housing 102 can be connected to drive shaft 74 to rotate therewith during polishing about an axis of rotation 107 which is substantially perpendicular to the surface of the polishing pad. The loading chamber 200 is located between housing 102 and base 104 to apply a load, i.e., a downward pressure, to base 104. The vertical position of base 104 relative to polishing pad 32 is also controlled by loading chamber 200. As described below, pressurization of a chamber 276 positioned between base 104 and substrate backing assembly 112 presses the substrate against the polishing pad.

The substrate backing assembly 112 includes a support structure 114, a flexure diaphragm 116 connected between support structure 114 and base 104, and a flexible member or membrane 118 connected to support structure 114. The flexible membrane 118 extends below support structure 114 to provide a mounting surface 274 for the substrate. Each of these elements will be explained in greater detail below.

The housing 102 is generally circular in shape to correspond to the circular configuration of the substrate to be polished. The housing includes an annular housing plate 120 and a generally cylindrical housing hub 122. The housing plate 120 may surround and be affixed to housing hub 122 by bolts 128. A cylindrical bushing 124 may fit into a vertical bore 126 through the housing hub, and two passages 130 and 132 may extend through the housing hub.

The base 104 is a generally ring-shaped body located beneath housing 102. The base 104 may be formed of a rigid material such as aluminum, stainless steel or fiber-reinforced plastic. A passage 156 may extend through the base to connect its upper surface 152 to its lower surface 150.

A bladder 160 may be attached to lower surface 150 of base 104 by a clamp ring 166. Bladder 160 may include a membrane 162 formed of flexible material, such as a silicone rubber. Membrane 162 should be elastic so that the bladder will expand downwardly when pressurized. Clamp ring 166 may be an annular body having a T-shaped cross-section. The edges 164 of membrane 162 are clamped between the crossbar of clamp ring 166 and the lower surface of the base. Clamp ring 166 may be secured to base 104 by screws or bolts (not shown).

The pump 93*b* (see FIG. 3) may be connected to bladder 160 via fluid line 92*b*, rotary coupling 90, channel 94*b* in drive shaft 74, passage 132 in housing 102, a flexible tube (not shown), passage 156 in base 104, and a passage 168 in clamp ring 166. Two fixtures 140 and 142 may provide attachment points to connect the flexible tube between housing 102 and base 104. If pump 93*b* directs a fluid, e.g., a gas, such as air, into bladder 160, the bladder will expand downwardly. On the other hand, if pump 93*b* evacuates bladder 160, it will contract. As discussed below, bladder 160 may be used to apply a downward pressure to support structure 114 and flexible membrane 118.

Gimbal mechanism 106 permits base 104 to pivot with respect to housing 102 so that the base may remain substantially parallel with the surface of the polishing pad. Gimbal mechanism 106 includes a gimbal rod 180 and a flexure ring 182. The upper end of gimbal rod 180 fits into a passage 188 through cylindrical bushing 124. The lower end of gimbal rod 180 includes an annular flange 184 which is secured to an inner portion of flexure ring 182 by, e.g., screws 186. The outer portion of flexure ring 182 is secured to base 104 by, e.g., screws (not shown). Gimbal rod 180 may slide vertically along passage 188 so that base 104 may move vertically with respect to housing 102. However, gimbal rod 180 prevents any lateral motion of base 104 with respect to housing 102.

Loading chamber 200 is formed by providing a seal between base 104 and housing 102. The seal is provided by a rolling diaphragm 202, an inner clamp ring 204, and an outer clamp ring 206. Rolling diaphragm 202, which may be formed of a sixty mil thick silicone sheet, is generally ring-shaped, with a flat middle section and protruding edges.

Inner clamp ring 204 clamps rolling diaphragm 202 to housing 102. Inner clamp ring 204 is secured to base 104, for example, by bolts 208, to firmly hold the inner edge of rolling diaphragm 202 against housing 102.

Outer clamp ring 206 clamps rolling diaphragm 202 to base 104. Outer clamp ring 206 is secured to base 104, e.g., by bolts (not shown), to hold the outer edge of rolling diaphragm 202 against the top surface of base 104. Thus, the space between housing 102 and base 104 is sealed to form loading chamber 200.

The pump 93*a* (see FIG. 3) may be connected to loading chamber 200 via fluid line 92*a*, rotary coupling 90, channel 94*a* in drive shaft 74, and passage 130 in housing 102. Fluid, e.g., a gas, such as air, is pumped into and out of loading chamber 200 to control the load applied to base 104. If pump 93*a* directs fluid into loading chamber 200, the chamber volume will increase as base 104 is pushed downwardly. On the other hand, if pump 93*a* pumps evacuates fluid from loading chamber 200, the chamber volume will decrease as base 104 is drawn upwardly.

Figure 5:
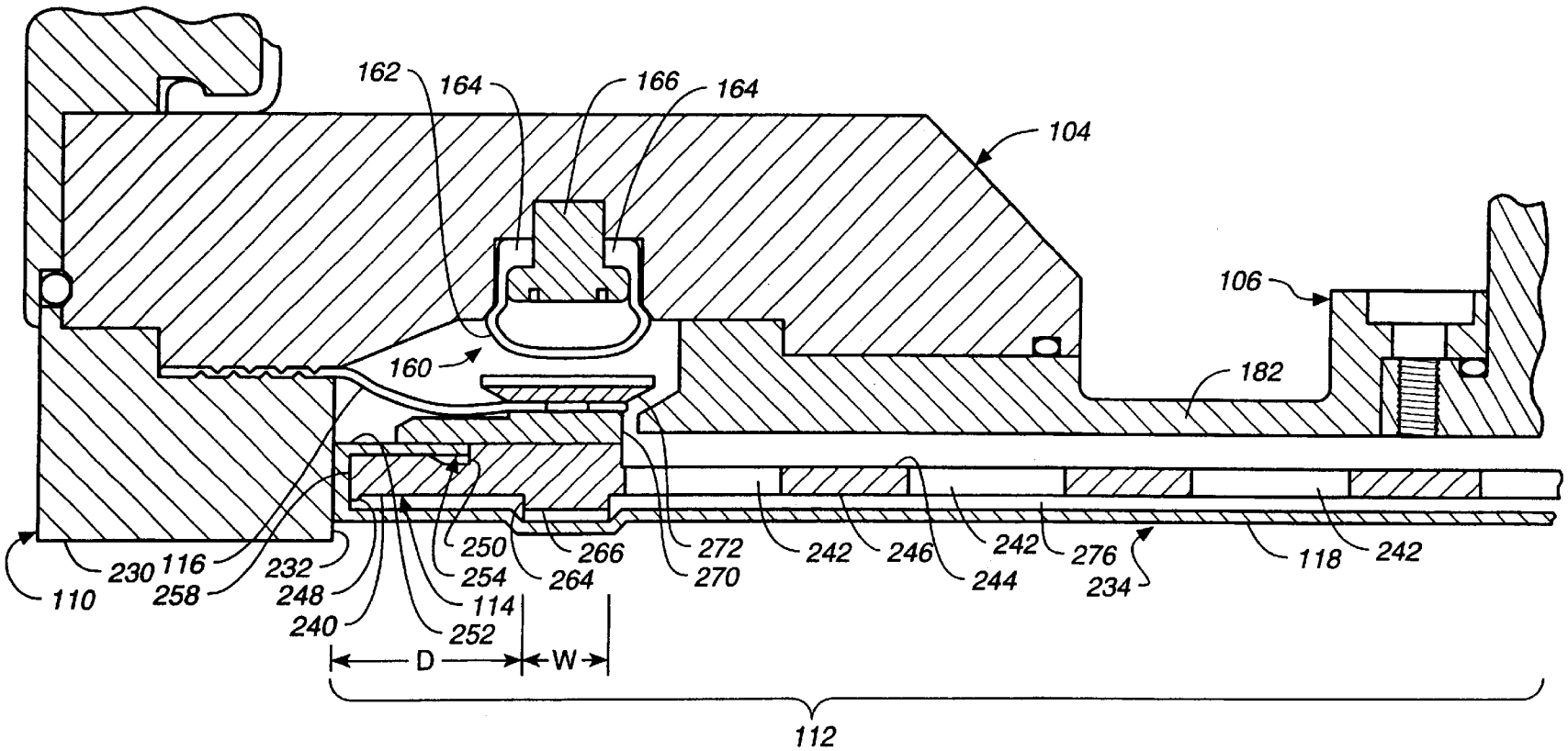
FIG. 5 is an enlarged view of the carrier head of FIG. 4 showing a projection extending from a lower surface of a support plate.

Referring to FIG. 5, retaining ring 110 may be secured at the outer edge of base 104. Retaining ring 110 is a generally annular ring having a substantially flat bottom surface 230. When fluid is pumped into loading chamber 200 and base 104 is pushed downwardly, retaining ring 110 is also pushed downwardly to apply a load to polishing pad 32. An inner surface 232 of retaining ring 110 defines, in conjunction with mounting surface 274 of flexible membrane 118, a substrate receiving recess 234. The retaining ring 110 prevents the substrate from escaping the substrate receiving recess and transfers the lateral load from the substrate to the base.

The substrate backing assembly 112 is located below base 104. Substrate backing assembly 112 includes support structure 114, flexure diaphragm 116 and flexible membrane 118. The flexible membrane 118 connects to and extends beneath support structure 114.

Support structure 114 includes a support plate 240, an annular lower clamp 270, and an annular upper clamp 272. Support plate 240 may be a generally disk-shaped rigid member with a plurality of apertures 242 therethrough. Support plate 240 may have an upper surface 244 with an annular grove 250 formed therein. In addition, support plate 240 may have a generally planar lower surface 246 with a downwardly-projecting lip 248 at its outer edge.

Support plate 240 may further include a generally annular projection 264 extending from lower surface 246. Annular projection 264 is located a distance D from the outer edge of support plate 240 and has a width W and a height H. The layer 266 of compressible material, such as a carrier film, may be attached to projection 264. As described below, projection 264 provides additional pressure to preselected portions of substrate 10 to reduce the edge effect. As such, projection 264 may contact an upper surface 262 of flexible membrane 118 in an area located interior to an outer edge of the substrate-receiving surface. The layer 266 of compressible material provides a region of soft contact to prevent damage to the substrate.

Flexure diaphragm 116 of substrate backing assembly 112 is a generally planar annular ring. The flexure diaphragm 116 is flexible and elastic, although it could be rigid in the radial and tangential directions. Flexure diaphragm 116 may formed of rubber, such as neoprene, an elastomeric-coated fabric, such as NYLON™ or NOMEX™, plastic, or a composite material, such as fiberglass.

Flexible membrane 118 is a generally circular sheet formed of a flexible and elastic material, such as chloroprene or ethylene propylene rubber. A portion 252 of membrane 118 extends around a lower corner of support plate 240 at lip 248, upwardly around an outer cylindrical surface 258 of the support plate, and inwardly along upper surface 244 or the support plate. A protruding edge 254 of membrane 118 may fit into annular groove 250 and be clamped between lower clamp 270 and the support plate.

During polishing, substrate 10 is positioned in substrate receiving recess 234 with the backside of the substrate positioned against mounting surface 274. The raised lip 248 of support plate 240 may press against the edge of the substrate through flexible membrane 118. In addition, annular projection 264 may press against substrate 10 through the flexible membrane.

The space between flexible membrane 118, support structure 114, flexure diaphragm 116, base 104, and gimbal mechanism 106 defines chamber 276. Pump 93*c* (see FIG. 3) may be connected to chamber 276 via fluid line 92*c*, rotary coupling 90, channel 94*c* in drive shaft 74, and a passage 190 through gimbal rod 180. If pump 93*c* directs a fluid, e.g., a gas, such as air, into chamber 276, then the chamber volume will increase as flexible membrane 118 is forced downwardly. On the other hand, if pump 93*c* evacuates chamber 276, then the chamber volume will decrease as the membrane is drawn upwardly. It is advantageous to use a gas rather than a liquid, since a gas is more compressible.

Figure 10:
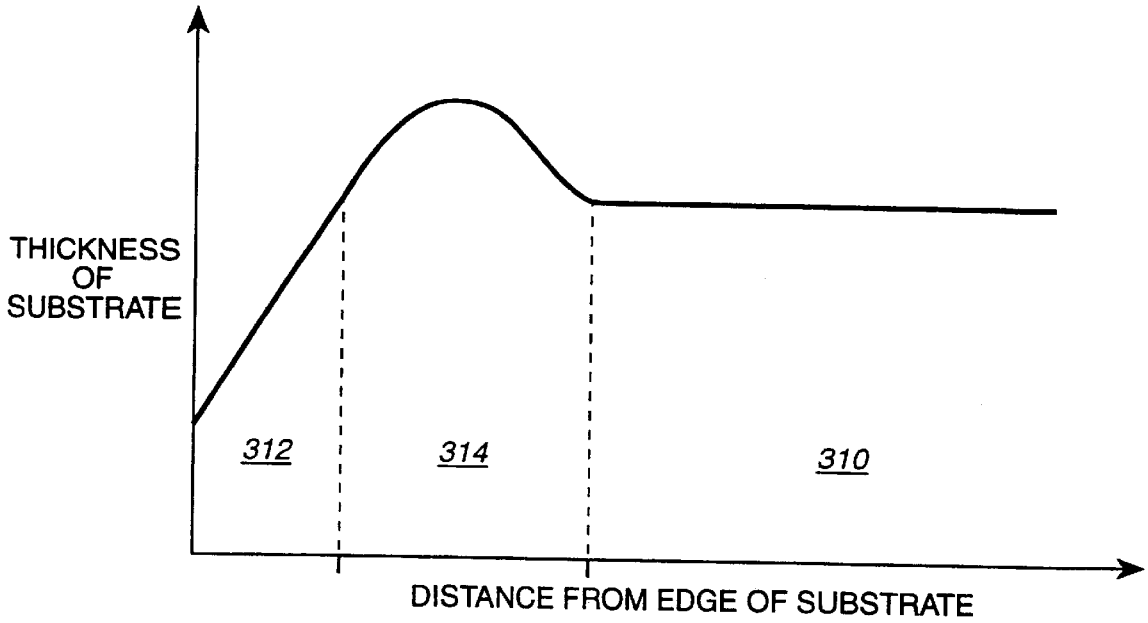
FIG. 10 is a graph illustrating the amount of material removed from a substrate as a function of the distance from the edge of the substrate.

Before discussing the operation of carrier head 100 during polishing, it will be useful to review the edge effect. As previously discussed, the edge effect typically causes the perimeter of the substrate to be over-polished. In addition, the edge effect may also cause a portion of the substrate to be under-polished. The results of the edge effect may be illustrated by referring to FIG. 10. In FIG. 10, the thickness (the y-axis) of a hypothetical circular substrate after being subjected to a CMP process is shown as a function of the distance from the edge of the substrate (the x-axis). As shown, after polishing, the substrate is substantially flat in a central region 310. However, an substantially annular region 312 at the perimeter of the substrate is overpolished. Additionally, the substrate may be underpolished in a substantially annular region 314, which may be located near the perimeter of the substrate adjacent and interior to overpolished region 312. Both the overpolished and underpolished regions are unsuitable for integrated circuit fabrication. The width of the overpolished and underpolished regions depends on the CMP process parameters, such as the polishing pad, slurry and substrate layer composition, the rotational speed of the platen and carrier head, and the total load on the substrate. However, for a 200 mm wafer, each region is typically between three and thirty millimeters wide.

Figure 11:
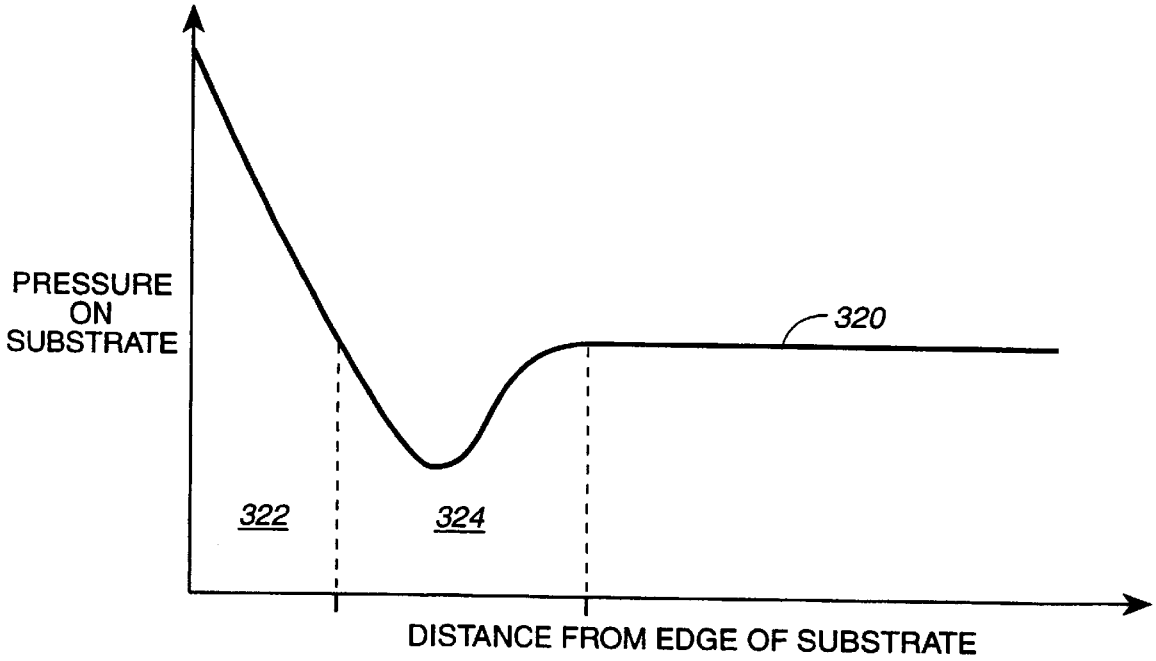
FIG. 11 is a graph illustrating the compression of the polishing pad as a function of distance from the edge of the substrate.

One possible cause of over-polishing is the existence of a high pressure region which may be generated at the perimeter of the substrate. One possible cause of under-polishing is the existence of an annular region of low pressure which may be generated near the substrate perimeter. Referring to FIG. 11, the pressure on the substrate (the y-axis) as a function of the distance from the edge of the substrate (the x-axis) is illustrated by curve 320. If the substrate moves relative to the polishing pad, then a region of high pressure 322 may be created at a leading edge of the substrate. Also, a region of low pressure 324 may be created adjacent and inwardly of high pressure region 322. The polishing rate is increased at the high pressure region, resulting in overpolishing (region 312), whereas the polishing rate is reduced at the low pressure region, resulting in underpolishing (region 314).

Without being limited to any particular theory, one possible explanation for the existence of low pressure region 324 is what may be termed a "displacement" effect. That is, the downward pressure of the substrate causes the polishing pad material to "flow" and be displaced across the edge of the substrate, creating a region which is less compressed. Another possible explanation is that flexible membrane 118 sticks to the retaining ring so that the outer edge of the membrane is held relatively fixed and less pressure is applied by the membrane near the edge of the substrate. Yet another explanation is that as the substrate contacts the retaining ring edge, the substrate deforms and a portion of the substrate deflects upwardly to create a region in which the polishing pad is less compressed.

Returning to FIG. 5, during polishing, annular projection 264 exerts a force on the backside of substrate 10 through flexible membrane 118. This contact creates a region of increased pressure on the substrate. This region of increased pressure may correspond to the location of low pressure region 324 (see FIG. 10). As such, annular projection 264 can increase the polishing rate in the otherwise underpolished region 314, thereby increasing the useable area of the substrate.

More specifically, pump 93*a* directs a fluid into loading chamber 200 to lower the substrate onto the polishing pad. Pump 93*c* also directs a fluid into chamber 276 to apply a downward load to substrate 10. In addition, as discussed above, pump 93*b* may pressurize bladder 160 so that the bladder applies a downward pressure to support structure 114. Thus, projection 264 applies an additional downward load through flexible membrane 118 to a potentially underpolished region of the substrate. The specific pressures for bladder 160 and chamber 276 to reduce underpolishing may be determined experimentally.

The distance D and the width W may be determined experimentally selected so that the projection 264 generally overlaps the otherwise underpolished region 314 of the substrate. For example, for a CMP operation involving the polishing of a tungsten layer on a 200 mm silicon wafer with an IC-1000 polishing pad (IC-1000 is a product name of Rodel, Inc., located in Newark, Del.), D was about 10 mm, W was about 12 mm, and H was about 20 mils. The pressure in bladder 160 was about 5.2 psi, and the pressure in chamber 200 was about 3.5 psi.

The additional pressure generated by projection 264 depends upon a number of factors, including the height of the projection, the compressibility of layer 266 (if present), the elasticity of flexure diaphragm 116, and the weight of support structure 114. In addition, the downward pressure applied by projection 264 may be increased by pressurizing bladder 160 so that the bladder applies an additional downward pressure to the support structure. Thus, the supplemental downward load from projection 264 may be a function solely of mechanical factors, such the weight of the support structure and the elasticity of the flexure diaphragm, or a function of both mechanical factors and the pressure in bladder 160.

It may be noted that in some polishing conditions the edge of the substrate is underpolished; i.e., there is no overpolished region 312, and underpolished region 314 extends to the edge of the substrate. In this situation, carrier head 100 need not include projection 264. Instead, additional pressure may be applied to the edge of the substrate by rim 240. The width of rim 240 may be adjusted to generally correspond to the width of the otherwise underpolished region 314. Bladder 160 may be pressurized to force support structure 112 downwardly and increase the pressure applied by rim 240. Thus, the additional pressure from rim 240 may be a function solely of mechanical factors, as discussed above, or a function of both mechanical factors and the pressure in bladder 160.

Figure 6:
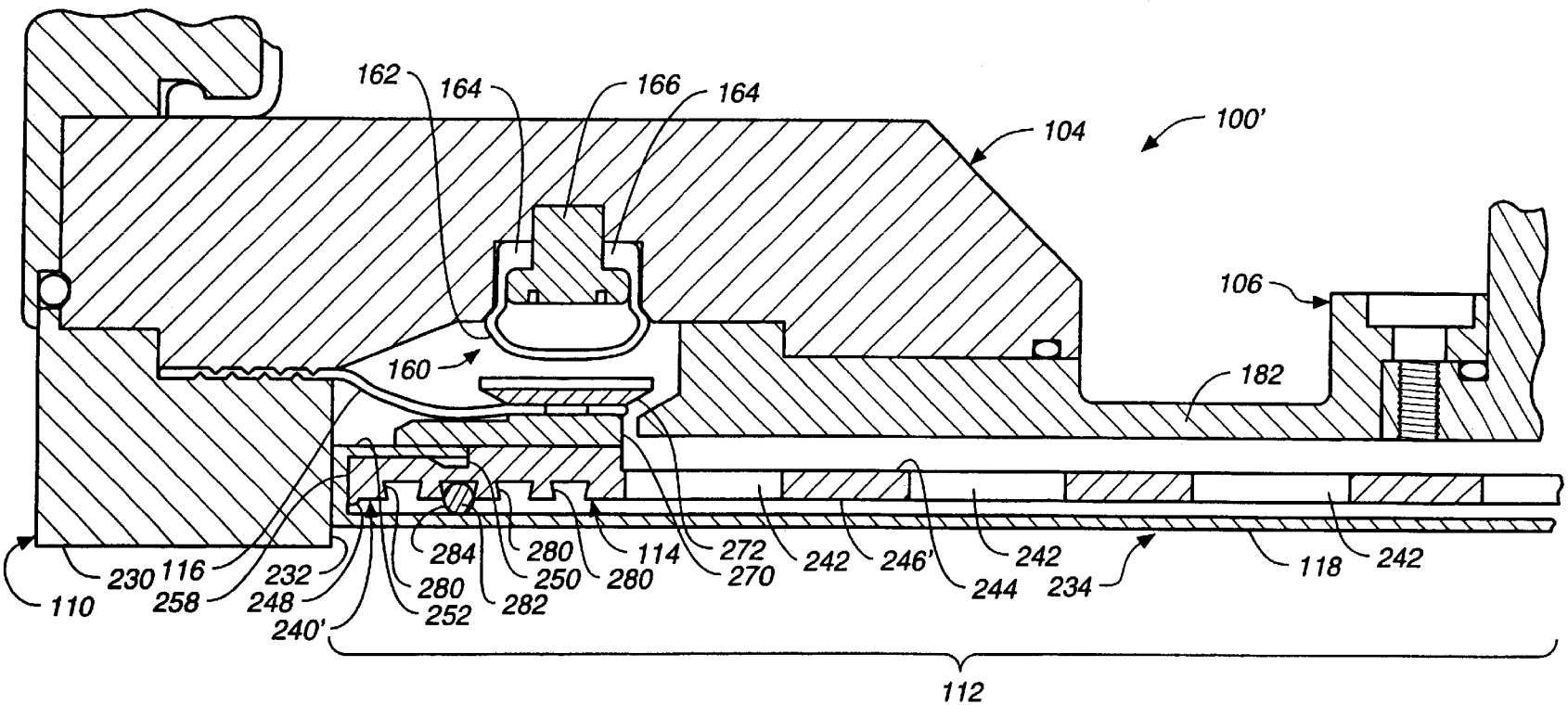
FIG. 6 is a schematic cross-sectional view of a carrier head having a detachable projection.

Referring to FIG. 6, carrier head 100' may include a detachable and adjustable projection 284, and lower surface 246' of support plate 240' may include a plurality of annular grooves 280. Grooves 280 may be arranged concentrically near the outer edge of support plate 240'. Each groove 280 may receive one O-ring 282, although some of the grooves may not be provided with O-rings. The portion of each O-ring 282 which extends below lower surface 246', in effect, provides projection 284. Projection 284 functions in the same fashion as projection 264 discussed above.

In addition, projection 284 may be detached by removing O-ring 282 from groove 280, and the location of the projection may be adjusted by placing a different O-ring having a different diameter into a different groove. If the operator keeps a kit of O-rings having diameters which match the diameters of the grooves, a single carrier head or a single carrier plate may be used for a variety of different polishing operations in which the optimal location of the projection differs. Although illustrated as an O-ring which fits into a groove, detachable projection 284 may also be implemented with magnets or by a snap fit arrangement.

Figure 7:
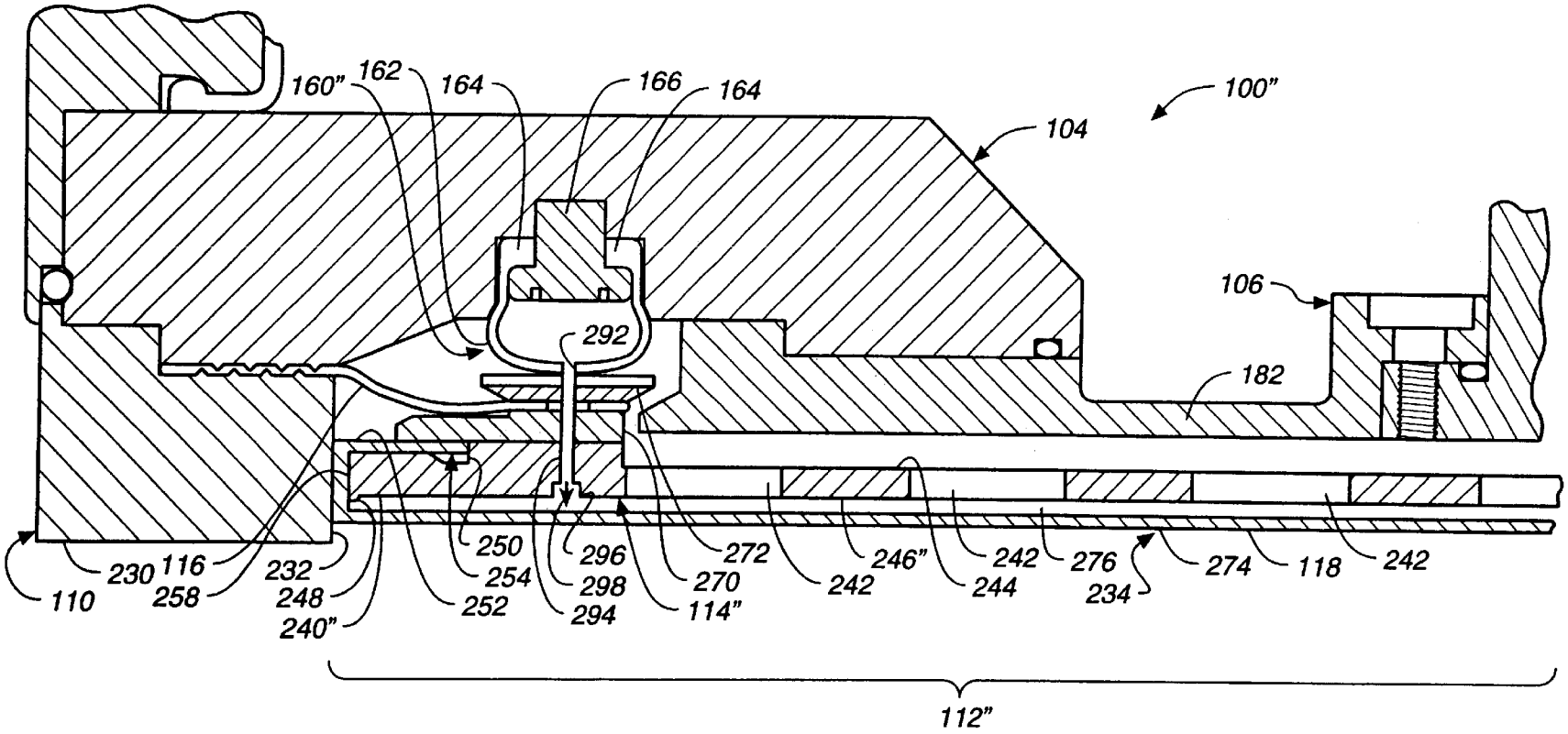
FIG. 7 is a schematic cross-sectional view of a carrier head including air jets.

Referring to FIG. 7, in yet another implementation, carrier head 100" includes fluid jets to locally increase the pressure at a potentially underpolished region. There may be a plurality of fluid jets spaced at equal angular intervals about the axis of rotation of the carrier head (only one is shown in the expanded and cross-sectional view of FIG. 7). Membrane 162" may include an aperture 292 which is aligned with a passage 294 through support structure 114". Passage 294 terminates at an outlet 296 in lower surface 246" of support plate 240". During polishing, pump 93*b* directs air into bladder 160". The fluid in bladder 160" then flows through aperture 292 and passage 294 and out of outlet 296 to create a localized air jet (illustrated by arrow 298). The air jet creates a local downward pressure on flexible membrane 118 and thus locally increases the pressure on the backside of substrate 10 in order to increase the polishing rate at a potentially underpolished region.

Another problem encountered in CMP is that the center of the substrate is often underpolished. This problem, which may be termed the "center slow effect", may occur even if pressure is uniformly applied to the backside of the substrate. Without being limited to any particular theory, one possible explanation for the center slow effect is that less slurry reaches the substrate center, resulting in a decreased polishing rate.

Figure 8:
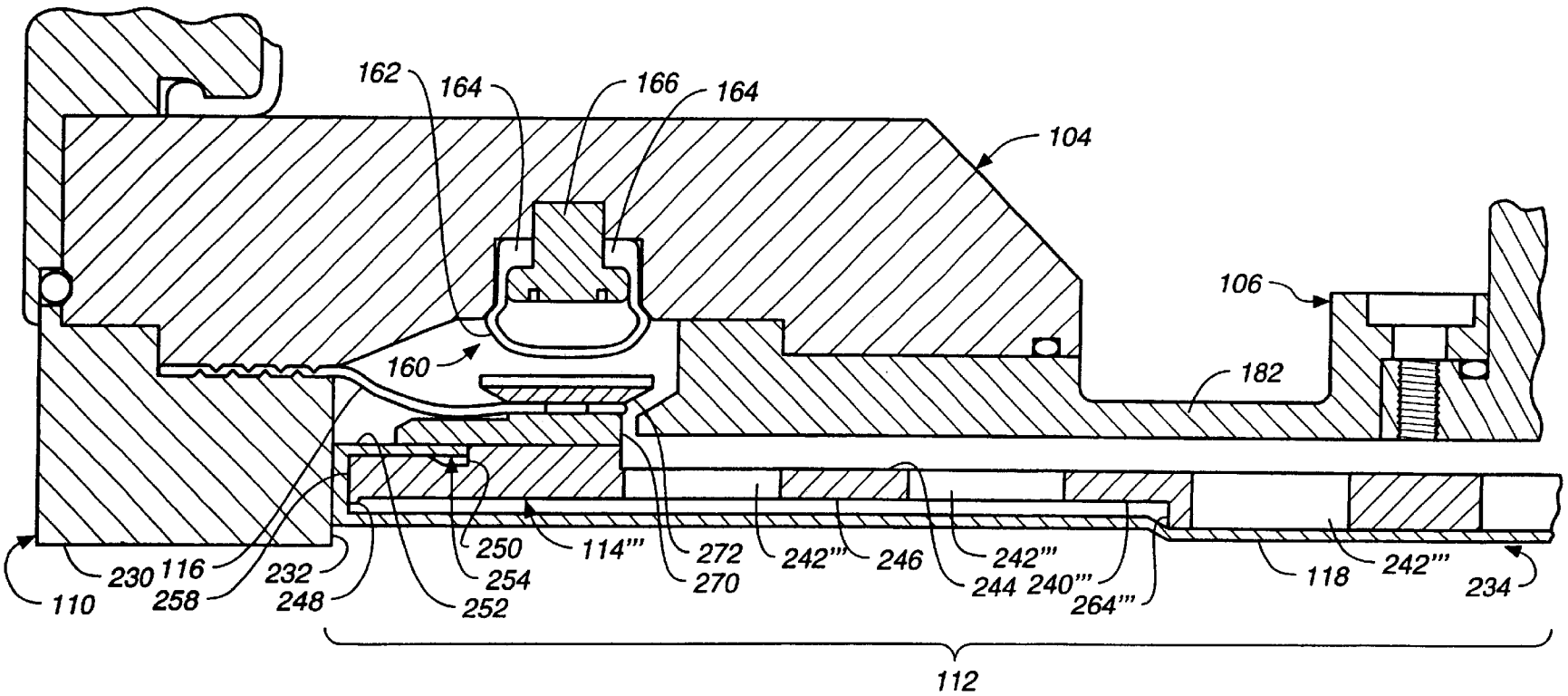
FIG. 8 is a schematic cross-sectional view of a carrier head with a projection in the center of the support plate.

Referring to FIG. 8, carrier head 100'41 may be used to reduce or minimize the center slow effect. Specifically, by providing the support plate 240'" with a projection 264'" which contacts the upper surface of the flexible membrane in a generally circular contact area near the center of the substrate-receiving surface, additional pressure may be applied to the potentially underpolished region at the center of the substrate. This additional pressure increases the polishing rate at the center of the substrate, improving polishing uniformity and reducing the center slow effect.

Figure 9:
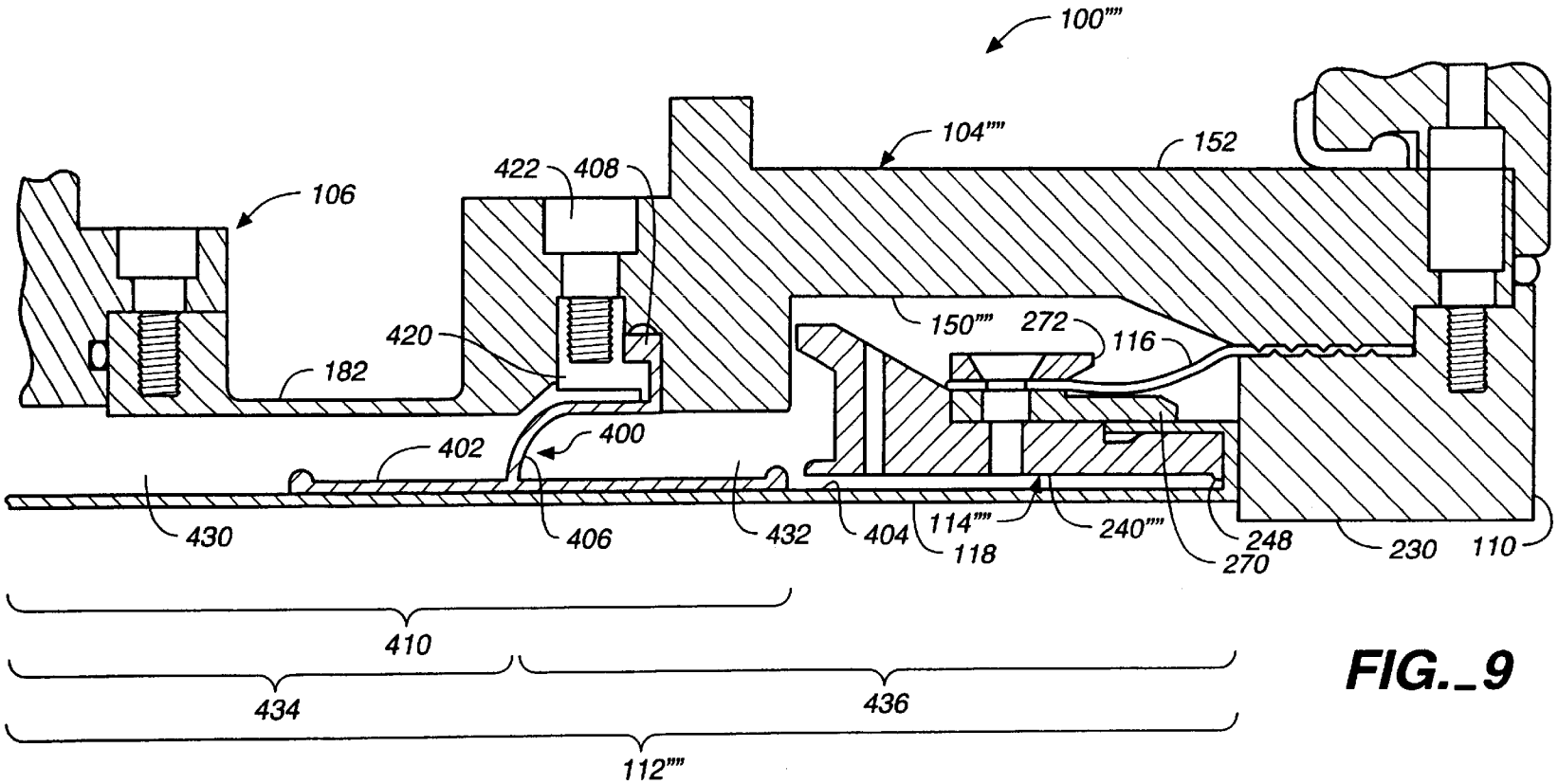
FIG. 9 is a schematic cross-sectional view of a carrier head having a chamber seal.

Referring to FIG. 9, in another embodiment, carrier head 100"" is designed to provide independently controllable pressures on the center and edge portions of the substrate in order to reduce the center slow effect. Carrier head 100"" does not include a bladder. Rather, carrier head 100"" includes a chamber seal 400 located between base 104"" and flexible membrane 118. Base 104"" is ring-shaped with a central aperture 410, and chamber seal 400 extends through the aperture. Chamber seal 400 is a generally annular body having a more-or-less T-shaped cross-section. Chamber seal 400 includes a generally flat base portion 402 which rests against an upper surface 404 of flexible membrane 118 and a curved stem portion 406 which is secured to base 104"". Stem portion 406 terminates in a protruding edge portion 408 that fits between a clamp ring 420 and base 104"". Screws or bolts 422 may be used to secure clamp ring 420 to base 104"".

Chamber seal 400 divides the space between membrane 118 and base 104"" (referred to above as chamber 276) into an inner chamber 430 and a substantially annular outer chamber 432. Pressurized fluids in both inner chamber 430 and outer chamber 432 force base portion 402 against membrane 118 to form a fluid-tight seal between chambers 430 and 432. Pump 93*b* may be connected to outer chamber 432 via fluid line 92*b*, rotary coupling 90, channel 94*b* in drive shaft 74, passage 132 in housing 102, a flexible tube (not shown) and a passageway (not shown) in base 104"". Similarly, pump 93*c* may be connected to inner chamber 430 via fluid line 92*c*, rotary coupling 90, channel 94*c* in drive shaft 74, and passage 190 in gimbal rod 180. By independently controlling the pressures in chambers 430 and 432, the downward load on an inner portion 434 and an outer annular portion 436 of membrane 118 may be independently controlled. Thus the pressures on an inner area and an outer annular area of the substrate may also be independently controlled. By selecting the appropriate pressures, polishing uniformity can be improved and the center slow effect can be reduced. Another advantage of chamber seal 400 is that backing assembly 112 may be removed from the carrier head without disconnecting base 104"" from housing 102 by detaching the retaining ring from the base.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a first port;

a base;

a flexible member connected to and extending beneath the base to define a chamber in fluid communication with the first port, a lower surface of the flexible member providing a substrate-receiving surface, the chamber applying a first pressure to an upper surface of the flexible member; and a second port in fluid communication with the chamber such that a fluid directed through the second port impinges upon a localized area of the upper surface of the flexible member to apply a second positive pressure in addition to the first pressure to the upper surface of the flexible member.

2. The carrier head of claim 1, wherein the localized area is substantially contiguous with a region of the substrate which is potentially underpolished.

3. A carrier head for a chemical mechanical polishing apparatus, comprising:

a first port;

a base;

a flexible member connected to and extending beneath the base to define a chamber in fluid communication with the first port, a lower surface of the flexible member providing a substrate-receiving surface; and a second port in fluid communication with the chamber, the second port positioned to direct a stream of fluid to impinge upon a localized area of the upper surface of the flexible member to create a corresponding area of increased pressure on the substrate.

4. The carrier head of claim 3 wherein the localized area of increased pressure is substantially contiguous with a region of the substrate which is potentially underpolished.

5. The carrier head of claim 3 wherein the localized area of increased pressure is located interior to an outer edge of the substrate-receiving surface.

6. The carrier head of claim 3 wherein the fluid is air.

7. The carrier head of claim 3 further comprising a support structure having a passage extending therethrough, where one end of the passage is fluidly coupled to a pump and another end of the passage is fluidly coupled to the second port.

8. A method of polishing a substrate, comprising:

placing a first face of the substrate against a substrate-receiving surface of a flexible member of a carrier head, the flexible member connected to and extending beneath a support structure of the carrier head to define a chamber;

positioning a second face of the substrate against a polishing pad;

pressurizing the chamber to apply a first force to an upper surface of the flexible member; and applying a second, additional force to the upper surface of the flexible member in a localized contact area.

9. The method of claim 8 wherein the localized contact area is located interior to an outer edge of the substrate-receiving surface.

10. The method of claim 8 wherein the localized contact area is substantially contiguous with a region of the substrate which is potentially underpolished.

11. The method of claim 8 wherein the step of applying an additional force includes contacting the upper surface of the flexible member with a projection which extends from the support structure.

12. The method of claim 11 wherein the second surface of the substrate includes a layer of tungsten, and the projection is a substantially annular ring composed of a compressible material located about 10 mm from an edge of the substrate receiving surface and having a width of about 12 mm and a height of about 20 mils.

13. The method of claim 8 wherein the step of applying an additional force includes contacting the upper surface of the flexible member with a fluid stream.

14. A carrier head for a chemical mechanical polishing apparatus, comprising:

a base;

a support structure movably connected to the base;

a flexible member connected to and extending beneath the support structure, a lower surface of the flexible member providing a substrate-receiving surface; and an annular seal connected to the base and abutting an upper surface of the flexible member to define an inner chamber and an outer chamber around the inner chamber, the inner and outer chambers being pressurizable to force the annular seal against the flexible member to create a substantially fluid-tight seal between the inner chamber and the outer chamber.

15. The carrier head of claim 14, further comprising a first pump fluidly coupled to the inner chamber and a second pump fluidly coupled to the outer chamber so that pressures in the chambers may be independently controlled.

16. The carrier head of claim 14 wherein the annular seal includes a base portion contacting the flexible member.

17. The carrier head of claim 16 wherein the annular seal includes a stem portion clamped to the base.

* * * * *